US008281901B2

(12) United States Patent
Kawai et al.

(10) Patent No.: US 8,281,901 B2
(45) Date of Patent: Oct. 9, 2012

(54) ELEVATOR DOOR EMERGENCY OPENING CONTROL SYSTEM

(75) Inventors: Kiyoji Kawai, Tokyo (JP); Masahiko Konishi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 685 days.

(21) Appl. No.: 12/520,549

(22) PCT Filed: Jan. 25, 2007

(86) PCT No.: PCT/JP2007/051167

§ 371 (c)(1),
(2), (4) Date: Jun. 22, 2009

(87) PCT Pub. No.: WO2008/090615

PCT Pub. Date: Jul. 31, 2008

(65) Prior Publication Data

US 2009/0314587 A1 Dec. 24, 2009

(51) Int. Cl.
*B66B 1/34* (2006.01)

(52) U.S. Cl. ..... 187/392; 187/314; 187/384

(58) Field of Classification Search ..... 187/313, 187/314, 316, 317, 380–389, 391–393, 396
See application file for complete search history.

(56) References Cited

U.S. PATENT DOCUMENTS

| | | | | |
|---|---|---|---|---|
| 5,355,975 | A * | 10/1994 | Laurutis | 187/270 |
| 5,950,150 | A * | 9/1999 | Lloyd et al. | 702/183 |
| 6,000,505 | A * | 12/1999 | Allen | 187/391 |
| 6,529,128 | B2 * | 3/2003 | Weng | 340/539.1 |
| 6,778,071 | B2 * | 8/2004 | Megerle | 340/332 |
| 7,182,174 | B2 * | 2/2007 | Parrini et al. | 182/18 |
| 7,461,723 | B2 * | 12/2008 | Kawai | 187/313 |
| 7,594,564 | B2 * | 9/2009 | Siikonen et al. | 187/384 |
| 7,621,378 | B2 * | 11/2009 | Kawai | 187/313 |
| 7,637,354 | B2 * | 12/2009 | Kawai | 187/313 |
| 7,669,695 | B2 * | 3/2010 | Hikita et al. | 187/284 |
| 7,677,363 | B2 * | 3/2010 | Kawai | 187/387 |
| 7,688,212 | B2 * | 3/2010 | Farley | 340/573.1 |
| 7,743,889 | B2 * | 6/2010 | Kawai | 187/313 |
| 7,926,621 | B2 * | 4/2011 | Kawai et al. | 187/387 |
| 8,113,320 | B2 * | 2/2012 | Kawai et al. | 187/384 |
| 2005/0173199 | A1 | 8/2005 | Kawai | |
| 2008/0067006 | A1 | 3/2008 | Hikita et al. | |

FOREIGN PATENT DOCUMENTS

| | | | |
|---|---|---|---|
| JP | 57 42934 | | 9/1982 |
| JP | 05147850 | A * | 6/1993 |
| JP | 2000 087667 | | 3/2000 |
| JP | 2006 89256 | | 4/2006 |
| WO | 2004 101418 | | 11/2004 |

OTHER PUBLICATIONS

U.S. Appl. No. 11/791,018, filed May 18, 2007, Kawai.
"Detection of abnormality in elevator (Seki et al.)", Image Lab, pp. 48-52, (2006).

* cited by examiner

*Primary Examiner* — Anthony Salata
(74) *Attorney, Agent, or Firm* — Oblon, Spivak, McClelland, Maier & Neustadt, L.L.P.

(57) ABSTRACT

In an elevator control system, an evacuation operation control section outputs a command for evacuation operation by an elevator in case of fire. Moreover, in case of fire, the evacuation operation control section controls opening and closing of a fire door adjacent to an elevator landing based on information from a passenger detector for detecting a passenger at the elevator landing and information on a fire situation in a vicinity of the elevator landing.

3 Claims, 3 Drawing Sheets

ELEVATOR DOOR EMERGENCY OPENING CONTROL SYSTEM

TECHNICAL FIELD

The present invention relates to an elevator control system for performing evacuation operation control for an elevator in case of fire in a building.

BACKGROUND ART

In general, a plurality of fire doors are installed in a building to prevent the spread of fire and smoke in case of fire. The fire doors are automatically closed by an operation of a fire detector nearby. The fire doors can also be closed by remote operation from a disaster prevention center.

In a conventional elevator group management system, a passenger number detector for detecting the number of waiting passengers is installed at an elevator landing. Then, when the number of waiting passengers at the elevator landing reaches a predetermined value or larger, a plurality of cars is allocated in response to a generated hall call. As a result, the plurality of cars are allocated with higher priority to the elevator landing where a larger number of passengers are waiting, thereby improving transport efficiency (for example, see Patent Document 1).

Patent Document 1: Japanese Utility Model Application Laid-open No. Sho 57-42934

DISCLOSURE OF THE INVENTION

Problem to be Solved by the Invention

The fire door as described above is also normally installed in the vicinity of an entrance of the elevator landing. If a passenger failing to escape for some reason is still present at the elevator landing when the fire detector operates to automatically close the fire door, the passenger is confined in the elevator landing, resulting in a lower evacuation efficiency. Moreover, although the conventional elevator group management system can improve the transport efficiency at the time of normal operation, evacuation operation by an elevator in case of fire is not particularly taken into consideration.

The present invention has been made in order to solve the problem as described above, and has an object of obtaining an elevator control system capable of further ensuring the prevention of confinement of a passenger in an elevator landing in case of fire to implement an efficient evacuation operation.

Means for Solving the Problem

An elevator control system according to the present invention includes an evacuation operation control section for outputting a command for an evacuation operation by an elevator and for controlling opening and closing of a fire door adjacent to an elevator landing based on information from passengers detector for detecting a passenger at the elevator landing and information on a fire situation in a vicinity of the elevator landing in case of fire.

BEST MODE FOR CARRYING OUT THE INVENTION

Hereinafter, a preferred embodiment of the present invention is described in reference to the drawings.

First Embodiment

Figure 1:
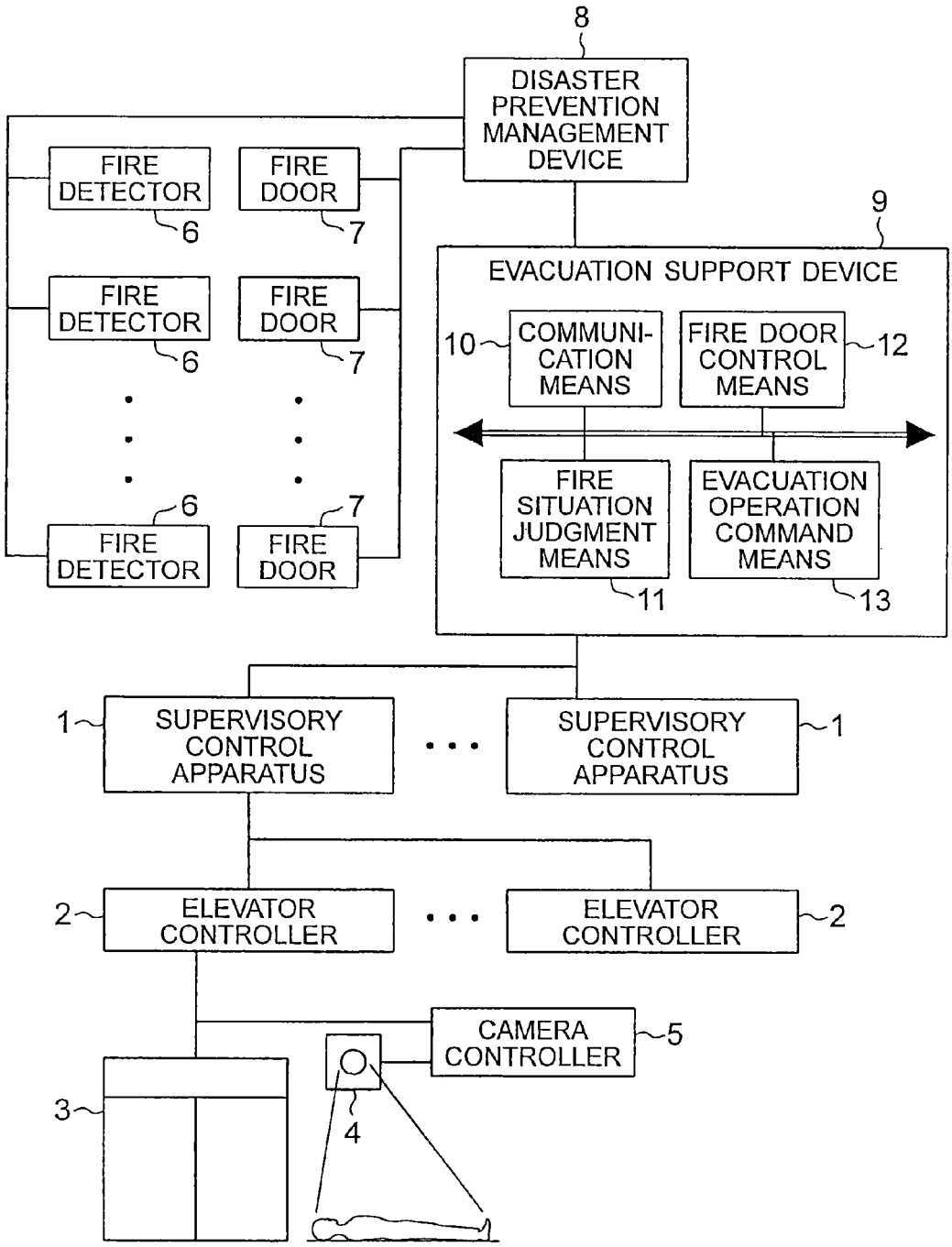
FIG. 1 is a block diagram illustrating an elevator control system according to a first embodiment of the present invention.

FIG. 1 is a block diagram illustrating an elevator control system according to a first embodiment of the present invention. In a building, a plurality of elevators are installed. A plurality of supervisory control apparatuses 1 are also provided in the building. Each of the supervisory control apparatuses 1 manages a plurality of corresponding elevator controllers 2 as a group. Each of the elevator controllers 2 controls an operation of a car 3 of the corresponding elevator.

At an elevator landing (entrance lobby) of each floor, a camera 4 serving as a passenger detector is installed. Each of the cameras 4 is connected to a camera controller 5 for controlling the camera 4 and for performing image processing/analysis. The camera controller 5 may be provided for each of the cameras 4, or may collectively control a plurality of the cameras 4.

A plurality of fire detectors 6 and a plurality of fire doors 7 are installed in the building. As the fire detector 6, for example, various detectors such as a smoke sensor, a temperature sensor, a fire detector, and a fire detector using image processing can be used.

A signal from the fire detector 6 is input to a disaster prevention management device 8. The disaster prevention management device 8 is installed in a disaster prevention center (monitor room) in the building to manage and control disaster prevention devices in the whole building. Therefore, the disaster prevention management device 8 also controls the opening/closing of the fire doors 7 and monitors the open/closed states thereof.

An evacuation support device 9 serving as an evacuation operation control section is connected to the supervisory control apparatus 1 and the disaster prevention management device 8. The evacuation support device 9 is installed in, for example, the disaster prevention center, and creates a plan for evacuation operation by the elevator and outputs a command for the evaluation operation based on the plan to the supervisory control apparatus 1 in case of fire.

The evacuation support device 9 also controls the opening/closing of the fire door 7 adjacent to the elevator landing based on information from the camera 4 and information on a fire situation in the vicinity of the elevator landing. The information from the camera 4 is input to the evacuation support device 9 through the camera controller 5, the elevator controller 2, and the supervisory control apparatus 1.

The evacuation support device 9 includes communication means 10, fire situation judgment means 11, fire door control means 12, and evacuation operation command means 13. The functions of the respective means 10 to 13 are realized by a microcomputer included in the evacuation support device 9. That is, programs (software) for realizing the functions of the respective means 10 to 13 are stored in the microcomputer.

The communication means 10 performs communication with the supervisory control apparatus 1 and the disaster prevention management device 8. The fire situation judgment means 11 judges the fire situation in the building based on fire information from the disaster prevention management device 8. The fire door control means 12 controls the opening/closing of the fire door 7 according to the fire situation and the passenger situation at the elevator landing. The evacuation operation command means 13 makes an evacuation operation plan using the elevators in the whole building in case of fire, and gives a command to the supervisory control apparatus 1.

Figure 2:
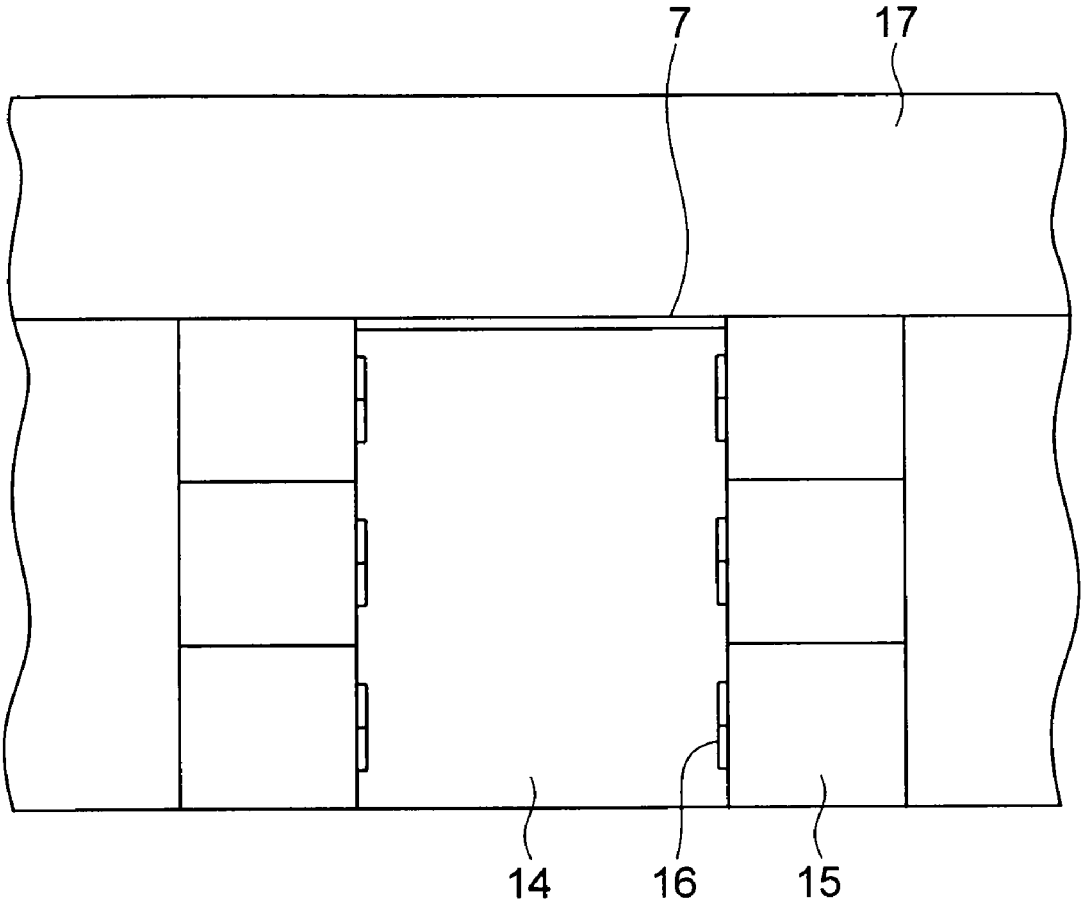
FIG. 2 is an explanatory view illustrating an example of a planar layout in the vicinity of an elevator landing of a building in which the elevator control system illustrated in FIG. 1 is installed.

FIG. 2 is an explanatory view illustrating an example of a planar layout in the vicinity of the elevator landing of the building in which the elevator control system illustrated in FIG. 1 is installed. In this example, three elevators 15 are provided on each side of an elevator landing 14. In the elevator landing 14, a landing door 16 is provided for each of the elevators 15. A fire door 7 is provided between the elevator landing 14 and a passage 17 adjacent thereto. As illustrated in FIG. 2, by closing the fire door 7 adjacent to the elevator landing 14, the elevator landing 14 becomes a closed space.

Next, an operation of the evacuation support device 9 is described. Upon determination of the fire by the disaster prevention management device 8, information thereof is input to the evacuation support device 9. As a result, the evacuation support device 9 outputs a command for implementing a fire emergency operation for all the elevators and also makes the evacuation operation plan. In the fire emergency operation, a car 3 is caused to arrive at an evacuation floor to park there.

Upon termination of the fire emergency operation, the evacuation support device 9 judges whether or not it is possible to start the evacuation operation. When it is impossible to start the evacuation operation, the cars 3 of all the elevators are left parked on the evacuation floor. When it is possible to start the evacuation operation, the evacuation operation is implemented based on the evacuation operation plan.

Upon start of the evacuation operation, the evacuation support device 9 repeatedly judges whether or not to continue the evacuation operation until the termination of the evacuation operation. When it is judged that the evacuation operation is not to be continued, the evacuation operation is interrupted to cause all the cars to arrive at the evacuation floor and to park there.

Figure 3:
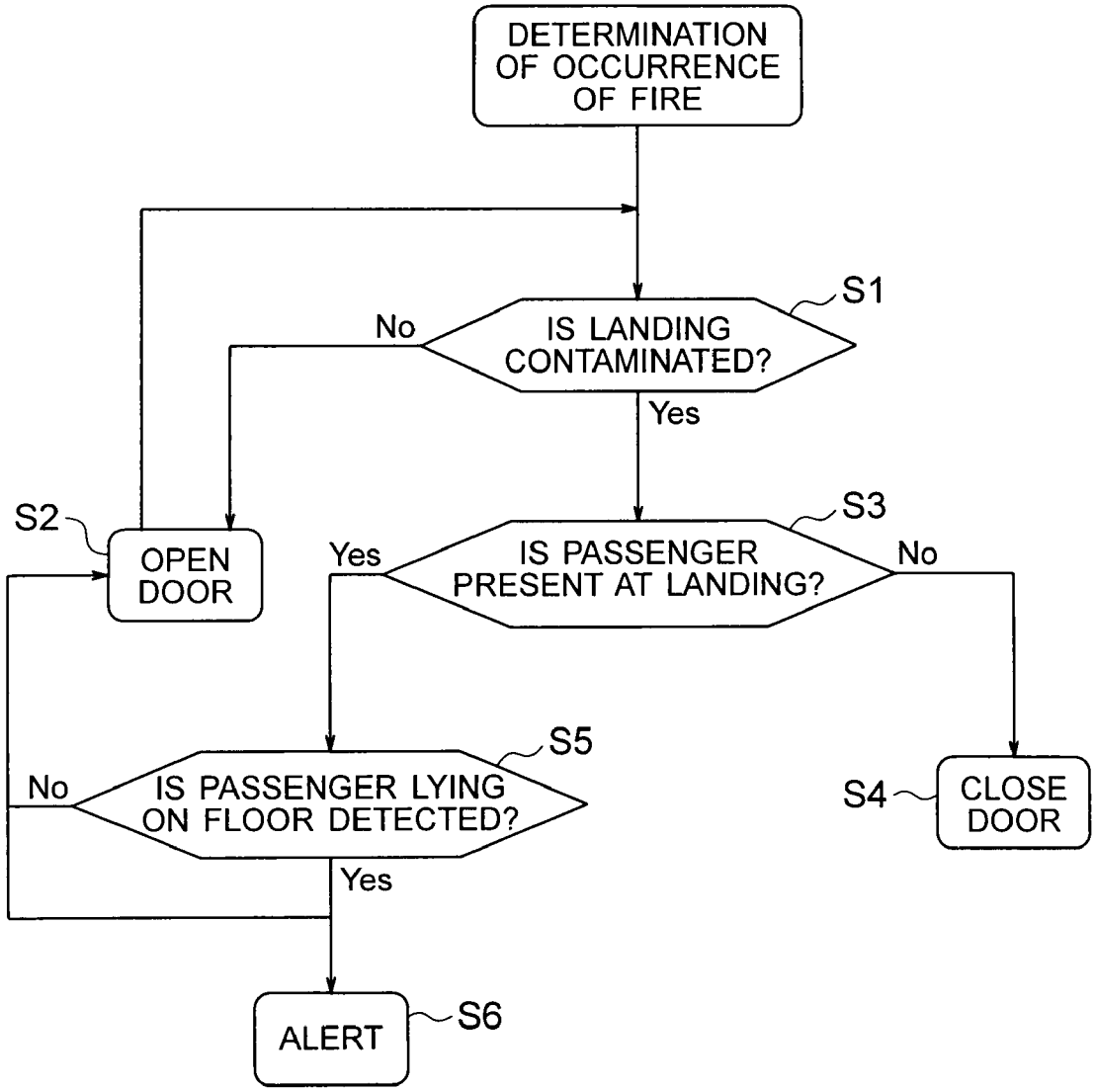
FIG. 3 is a flowchart illustrating an operation of a fire door control means illustrated in FIG. 1.

FIG. 3 is a flowchart illustrating an operation of the fire door control means 12 illustrated in FIG. 1. Upon determination of the occurrence of a fire, it is judged whether or not the elevator landing on each floor is contaminated by smoke (Step S1). If the elevator landing is not contaminated, the fire door 7 is left open (Step S2) and the judgment of the presence/absence of contamination of the elevator landing is continued.

If contamination of the elevator landing is verified, it is judged whether or not a passenger is present at the elevator landing based on information from the camera controller 5 (Step S3). Then, when there is no passenger, a door closing command for the fire door 7 adjacent to the elevator landing contaminated by smoke is output.

If a passenger is still present at the elevator landing contaminated by smoke, it is judged whether or not the passenger is lying on the floor based on the information from the camera controller 5 (Step S5). A technique for detecting the presence of a person and abnormality based on the information from the camera 4 is described in, for example, "Detection of abnormality in elevator (Seki et al.)", "Image Lab, March, 2006, pp. 48-52". This document describes a technique for detecting an immobile person inside the car. However, it is considered that the presence/absence of a passenger who is lying on the floor and immobile at the elevator landing can be judged by the same technique.

If it is judged that the passenger still present at the elevator landing contaminated by smoke is lying on the floor, the disaster prevention center is alerted for a speedy rescue (Step S6). If the passenger is still present at the elevator landing contaminated by smoke, the fire door 7 adjacent to the elevator landing is left open regardless of whether or not the passenger is lying on the floor (Step S2) and the above-mentioned monitoring is repeated.

In the elevator control system as described above, the evacuation support device 9 controls the opening/closing of the fire door 7 adjacent to the elevator landing based on the information from the camera 4 provided at the elevator landing and the information from the fire detector 6 provided at the elevator landing. Therefore, in case of fire, the prevention of confinement of a passenger in the elevator landing can be further ensured. Accordingly, an efficient evacuation operation can be implemented.

Moreover, in case of fire, the evacuation support device 9 judges whether or not the elevator landing is contaminated by smoke and also judges whether or not a passenger is still present at the elevator landing contaminated by smoke. If a passenger is still present at the elevator landing contaminated by smoke, the fire door 7 adjacent to the elevator landing is left open. Therefore, the prevention of confinement of the passenger in the elevator landing can be further ensured.

Further, if a passenger is still present at the elevator landing contaminated by smoke, the evacuation support device 9 judges whether or not the passenger is lying on the floor. The disaster prevention center is alerted when the passenger is lying on the floor, and hence a passenger lying on the floor can be quickly rescued.

It should be noted that the above-mentioned fire door is a device for shutting off flame or smoke caused by a fire. For example, the fire door includes a fire shutter and the like.

In the above-mentioned example, signals are transmitted and received between the evacuation support device 9 and the fire detector 6 or the fire door 7 through the disaster prevention management device 8, but the transmission and reception of the signals can be directly performed without the intermediation of the disaster prevention management device 8.

Further, in the above-mentioned example, the functions of the evacuation operation control section are realized by a single computer. However, the functions thereof may be allocated to and performed by a plurality of computers. The evacuation operation control section may also be provided, for example, in the disaster prevention management device or the supervisory control apparatus.

Further, in the above-mentioned example, the contamination of the elevator landing by smoke is monitored based on the information from the fire detector 6 provided at the elevator landing, but upcoming contamination of the elevator landing by smoke may be predicted based on information from the fire detector provided in a space adjacent to the elevator landing to control the fire door.

The invention claimed is:

1. An elevator control system comprising an evacuation operation control section for outputting a command for evacuation operation by an elevator and for controlling opening and closing of a fire door adjacent to an elevator landing based on information from a passenger detector for detecting a passenger at the elevator landing and information on a fire situation in a vicinity of the elevator landing in case of fire;

wherein, in case of fire, the evacuation operation control section judges whether or not the elevator landing is contaminated by smoke based on the information on the fire situation and also judges whether or not a passenger is still present at the elevator landing contaminated by smoke, and leaves the fire door adjacent to the elevator landing open when a passenger is still present at the elevator landing contaminated by smoke.

2. The elevator control system according to claim 1, wherein the evacuation operation control section judges whether or not a passenger is lying on a floor when a passenger is still present at the elevator landing contaminated by smoke, and alerts a monitor room when the passenger is lying on the floor.

3. An elevator control system comprising an evacuation operation control section for outputting a command for evacuation operation by an elevator and for controlling opening and closing of a fire door adjacent to an elevator landing based on information from a passenger detector for detecting a passenger at the elevator landing and information on a fire situation in a vicinity of the elevator landing in case of fire, wherein, in case of fire, the evacuation operation control section predicts upcoming contamination of the elevator landing by smoke based on the information on the fire situation and also judges whether or not a passenger is still present at the elevator landing soon to be contaminated by smoke, and leaves the fire door adjacent to the elevator landing open when a passenger is still present at the elevator landing soon to be contaminated by smoke.

* * * * *